US005722746A

United States Patent [19]

Hull et al.

[11] Patent Number: 5,722,746

[45] Date of Patent: Mar. 3, 1998

[54] APPARATUS FOR SUPPORTING A TILE COUNTER CAP

[76] Inventors: Harold L. Hull, deceased, late of Sparks, Nev.; by Cathy D. Santa Cruz, Trustee, 401 Canyon Way, #43, Sparks, Nev. 89434; Eugene M. Peterson, deceased, late of Reno, Nev.; by Jacqueline Peterson, Administrator, 1405 Pass Dr., Reno, Nev. 89509

[21] Appl. No.: 547,284

[22] Filed: Oct. 24, 1995

[51] Int. Cl.[6] ..... A47B 96/18

[52] U.S. Cl. ..... 312/140.3; 108/27; 52/287.1

[58] Field of Search ..... 312/140.3; 108/27; 52/254, 255, 287.1, 288.1, 716.3, 716.4

[56] References Cited

U.S. PATENT DOCUMENTS

| | | | |
|---|---|---|---|
| 3,953,268 | 4/1976 | Dillon | 52/287.1 X |
| 4,624,087 | 11/1986 | Schneller | 52/288.1 X |
| 5,060,438 | 10/1991 | O'Rourke | 52/371 |
| 5,073,430 | 12/1991 | Aidan | 428/43 |
| 5,348,384 | 9/1994 | Hull et al. | 312/140.3 |

*Primary Examiner*—Brian K. Green

[57] ABSTRACT

In a tile covered structure, the improvement being a corner tile support strip attached between the vertical surface and the vertical leg sections of the corner tiles which includes an "L-shaped" first main body screed and an elongated rectangular stress barrier member with the stress barrier member being attached to the screed by caulking.

4 Claims, 2 Drawing Sheets

APPARATUS FOR SUPPORTING A TILE COUNTER CAP

"FIELD OF THE INVENTION"

The present invention relates to the tiling of countertops or cabinets but more particularly to support of the tile cap that forms the corner at the front of the tile cap.

"BACKGROUND OF THE INVENTION"

It is known in the tiling field that when tiling countertops, cabinets or the like, many times cracking of the tile cap is incurred. Therefore it is desirous to provide a method and/or apparatus which eliminates or highly reduces the occurrence of the above mentioned problem.

In the past, attempts have been made to reduce the likelihood of cracking the adhesive and/or the tile cap. Such as U.S. Pat. No. 5,060,438, wherein they provide a method and apparatus which includes a channel shaped cap support strip for a cap strip of a tiled countertop which is formed with a plurality of projecting tongues that are embedded within the adhesive that overlies the horizontal surface of the counter, with the body of the cap support strip channel being nailed to the vertical surface of the front of the counter. The tongues, embedded in the adhesive that holds the tile in place, hold the upper part of the cap support strip securely tied to the countertop and "in theory" helps to prevent cracking of the tile caps; however, in practice this and other prior art apparatus's have proved unsatisfactory due to the traveling stress in both walls and floors which is transferred to the tile cap.

It is to be noted that our previously issued U.S. Pat. No. 5,348,384 addresses and overcomes many of the prior art difficulties; however, the present invention proves to resolve further difficulties in a manner heretofore not taught as will be seen within the later specification and claims.

Traveling stress in both walls and floors have been recognized and addressed in the prior art in the ceramic tile trade since its beginning. Most workmen in the trade today are cognizant of the various causes and conditions that create this problem but are helpless to minimize or alleviate them.

In relatively recent times traveling stress in the rail of mud-set countertops has been an increasing problem. The inventors of the present invention have consulted with every knowledgeable source immediately available, and the best answer found was both vague and ambiguous. This is due to the consensus opinion that stress is caused by movement. That kind of answer gives one little satisfaction when standing and looking at a countertop with stress-cracked tile running half way around it, as if a pair of giant hands had torn those tiles apart as easily as a person tears a piece of newspaper.

With this in mind, we have analyzed the possible sources of movement starting at the bottom. First, there is the compaction of the soil under a post footing. The moisture in the soil could dry out with a possibility of a 1/32 inch movement downward. Second, the redwood block under the post sitting on the footing could compress 1/32 inch. Third, the post itself could shrink 1/32 inch. This next item has a potential for being the worst culprit of all the others put together, that being ¾ inch flakeboard sub-flooring. The reason for this is, even though bonding resins are waterproof, the wood fibers are not. When left out in the weather before the roof is on, they will expand ¼ inch. This doesn't affect its structural integrity; however, covering it with underlayment and setting cabinets on it is tantamount to setting cabinets over carpet pad, and in a worst case scenario, the potential for movement is up to ⅜ inch.

In the prior art, most kitchen cabinets in the past were custom fabricated as a single unit built from solid ¾ inch wood or ¾ inch plywood, while today's cabinets are primarily modular units and the only things that are ¾ inch solid wood are face frames and doors. The side panels are ⅜ inch particleboard and the back panels are ¼ inch masonite. The bottoms and shelving are ½ inch masonite, veneered. In the past, face frames were nailed and glued and had corner and angle blocking. Most modular units today are glued and might have a few pins or staples in them. One can readily see that these newer cabinets do not contribute to a stable base for the mud countertops. The tile manual recommends slash cutting in ¾ inch plywood tops or 1 inch×6 inch boards placed at ¼ inch intervals. However, in the opinion of many workmen it can be argued that a solid ¾ inch plywood top contributes more to the structural integrity of the whole, especially on the front of the cabinet because of the fact there is a 4 inch toe kick at the base of the cabinet. This means the face of the cabinet is cantilevered and is getting all its support from the side panels. This is especially true on overhanging countertops with a serving area. In the latter, it is imperative that, in order to get any support at all, the korbels be aligned over the modular unit side panel joints.

Two other points must be considered when discussing particleboard: first, the fact that particleboard resin used in the manufacturing process contains formaldehyde as a drying agent, and a 4 Ft.×8 Ft. sheet of particleboard can shrink in size up to ⅛ inch during the curing. It also takes up moisture very readily under extremely damp conditions. In either case, there is a possibility of popping its own glue joints. Second, there is a tendency to buckle under stress. Now that the movement that can transpire from the ground to the underlayment and the variables involved in the cabinet itself are understood, next comes the big question! How does all this downward vertical movement relate to stress in the rail?

This can best be answered by visualizing a sectional view of a cabinet with a tile countertop. The first thing that happens is the downward movement starting at the base of the toe kick, which is 20 inches from the back wall. However, because the face frame is 24 inches from the back wall, there is a 20% increase in movement at the face of the cabinet. There is no downward stress on the back of the cabinet, as it is firmly secured to the outside wall, where it remains stable.

Now visualize the rough top, which ms essentially an elongated rectangular member that is firmly secured to the back wall of the cabinet and the hardwood face frame. The stress is now transferred to the rough top, and by its downward movement, changes our rough top into a parallelogram when viewed from a level plane with the pressure point being the top front corner, which essentially acts as a wedge. One must bear in mind that the mud-set ceramic countertop is a rigid, monolithic unit without tolerance for flexibility. At this point the stress is telegraphed through the conventional prior art A-metal and the mud backing on the rail apron. Next, a basic law of physics comes into play, the law of compound leverage. The stress is transferred vertically to the top of the rail seeking the weakest point to expend its energies which is on the tail side of the rail. The origin of this stress usually starts in the middle of an area that has the most severe movement. Then it goes through the aforementioned steps and travels in both directions of the rail until its energies have been released.

It is therefore desirable to provide means to remove and keep the stress generated by any one or any combination of the above described stresses from reaching the tile corner cap to reduce its potential to crack, and it is this problem which the present invention addresses.

"SUMMARY OF THE INVENTION"

It is therefore a primary object to provide a method and apparatus to isolate the stresses created in the structures of the cabinets and their foundations and to keep them from reaching the tile corner cap to minimize cracking.

Another object is to provide a corner tile support strip (hereafter referred to as "P-strip II") in a form which will perform as a mud screed in lieu of the prior art metal strip.

Another object is to replace the conventional A-metal screed strip and/or the P-strip of our U.S. Pat. No. 5,348,384, with the above noted P-strip II.

Still another important object is to construct the P-strip II in two units consisting of a first main body screed, which may be made from metal, and a second stress barrier member, which in the preferred embodiment, is made of a substantially rigid and high density small bead foam.

Yet another object is to provide the P-strip II and/or screed with multiple nailing slots there through which are of a shape and size to receive a fastener means, such as a nail therein, so as to fixedly attach the P-strip II and/or screed to the cabinet structure.

Also another object of the present invention is to shape the above noted "P" strip (which is also our first main body screed) substantially to form a backward "L" having a short leg which forms a lip and a long leg, with the long leg being substantially straight forming an elongated flat surface having an elongated top edge which is folded over upon itself forming an elongated hem, and the hem, the flat surface and the lip each facing toward the vertical leg of a corner tile structure.

Still another object of the present invention is to provide substantially an elongated, rectangular stress barrier member having a first side and a tile-side surface. The first side conforming in size and shape to mate with the hem and the elongated flat surface when installed, and the stress barrier member being fixidly attached to the screed by caulking.

A further object is to apply a thin, smooth plastic coating on the tile-side surface of the stress barrier and on at least one of the its longest edges for reinforcement, if so desired.

Yet another object of the present invention is to provide a method of installing an "L-shaped" screed and a stress barrier member in a tile covered structure having a horizontal and vertical surface meeting to form a structure corner and having a plurality of tiles covering at least part of said horizontal surface and a plurality of corner tiles each formed of substantially horizontal and vertical leg sections positioned at the corner, the tiles being secured to the structure by adhesive material between the tiles and structure, comprising the steps of;

a. stapling a waterproof membrane to the rough counter top;

b. installing a reinforcing mesh over the membrane with nails;

c. nailing the "L-shaped" screed to the edge of the countertop to obtain a level plane;

d. floating setting bed mortar to obtain a level plane;

e. installing and attaching the stress barrier to the "L-shaped" screed by using a thin bead of caulking;

f. installing an adhesive on the setting bed mortar and face of the stress barrier, and;

g. installing a tile in the conventional manner.

Other objects and advantages will become obvious when taken into consideration with the following specification and drawings.

"DETAILED DESCRIPTION OF THE DRAWINGS"

Figure 1:
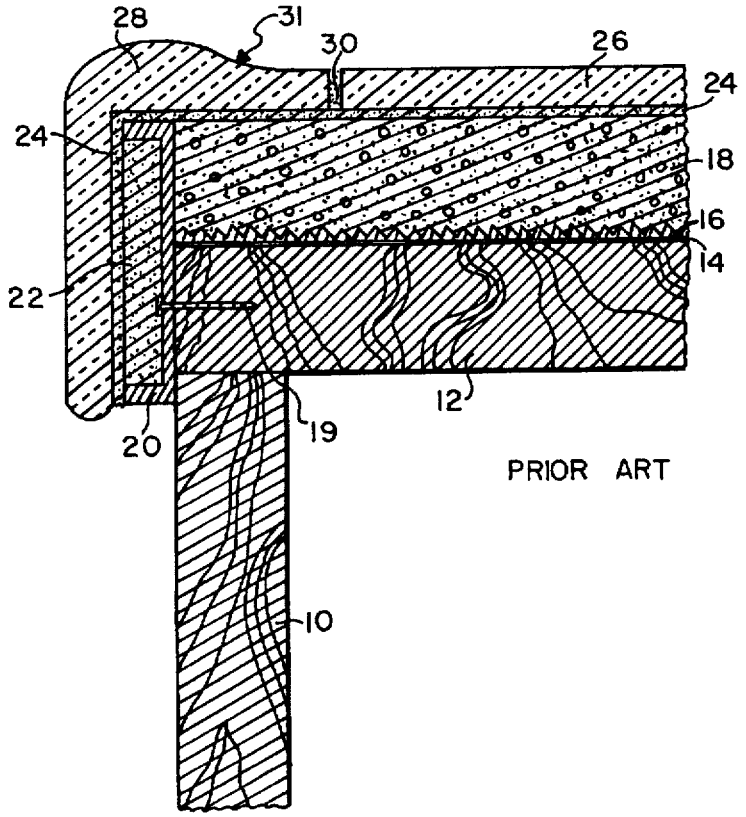
FIG. 1 is substantially a sectional view of a typical prior art installation.

Referring now in detail to the drawings wherein like characters refer to like elements throughout the various drawings. In FIG. 1, a typical prior art installation is shown wherein 10 is a wooden upright support such as a cabinet face frame with 12 being a wooden base and 14 being a membrane such as roofing felt or polyethylene film while 16 is a metal lath on which the mortar base bed 18 is spread with 20 being a typical punched metal strip attached to the front edge of the cabinet by multiple nails 19 and used as a screed and support for the countertop trim 28 and is filled with wall mortar 22. 24 is a bond coat which is spread on the mortar base 18 and wall mortar 22 which have been allowed to cure. Now the tile 26 and the tile trim 28 are set on the bond coat 24 and grout 30 applied.

It will now be seen that any downward or other movements as previously described of the wooden structures involved can only transfer the stress created to the tile 28, causing it to fracture generally in the area of arrow 31.

It is to be noted that the present invention is substantially a corner tile support strip (hereafter referred to as an "P-strip II") attached between the vertical surface and the vertical leg sections of the corner tiles.

Figure 2:
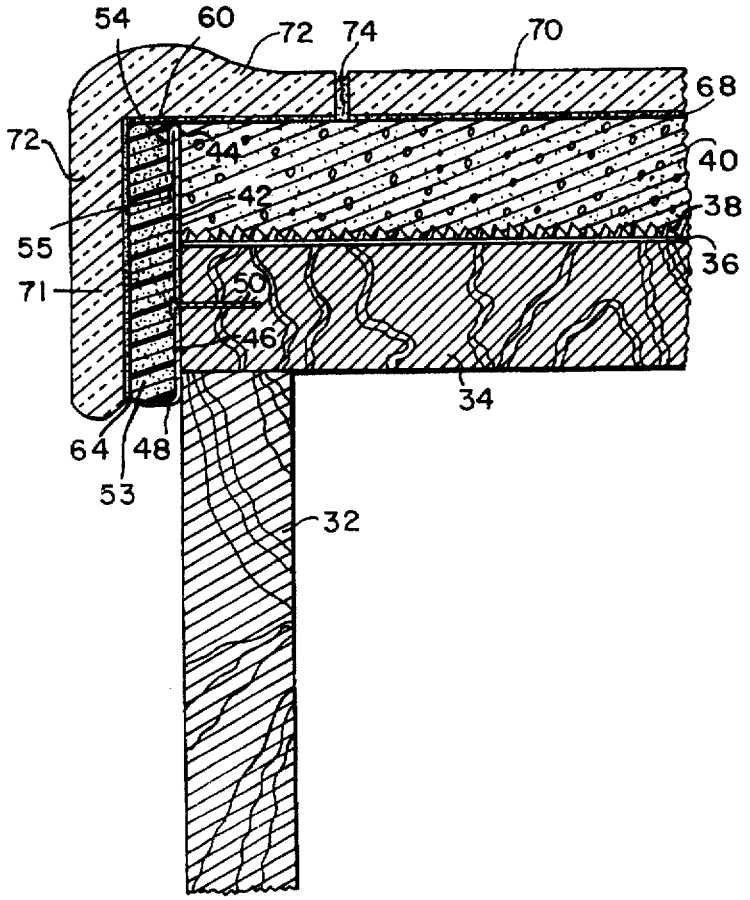
FIG. 2 is substantially a sectional view of our present invention.

Referring now to FIG. 2 wherein a typical installation of the present invention is shown. Therein 32 is a wooden upright support such as a cabinet face frame with 34 being a wooden base and 36 being a membrane such as roofing felt or polyethylene film while 38 is a metal lath on which the mortar base bed 40 is spread. 42 is substantially an elongated strip which is a first unit of our new invention and is a first main body screed which is made in the preferred embodiment from metal, such as 24 or 26 gauge, or any other suitable material of choice. The "P-strip II" 42 (which is also our first main body screed) is shaped substantially to form a backward "L" having a short leg which forms a lip 48 and a long leg 49, with the long leg 49 being substantially straight forming an elongated flat surface 46 having an elongated top edge which is folded over upon itself forming an elongated hem 44, with the hem 44, the flat surface 46 and the lip 48 each facing toward the vertical leg 71 of the corner tile structure 72.

Figure 3:
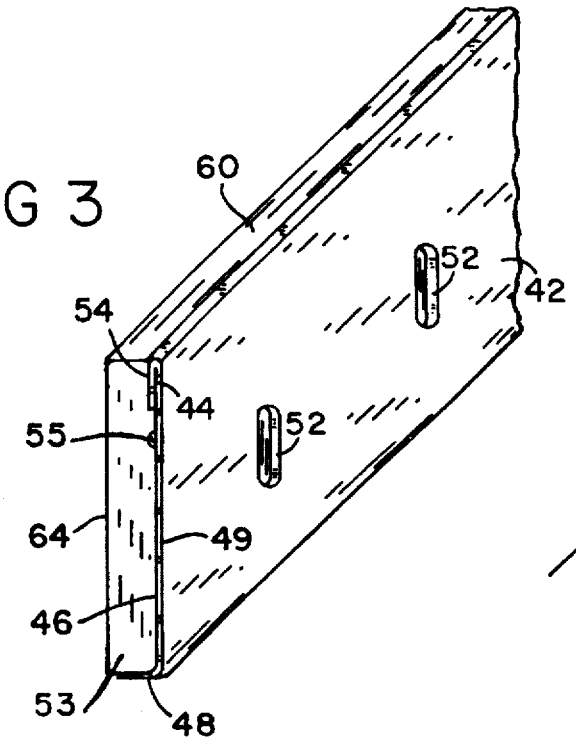
FIG. 3 is substantially an assembled perspective view of the present invention.
Figure 4:
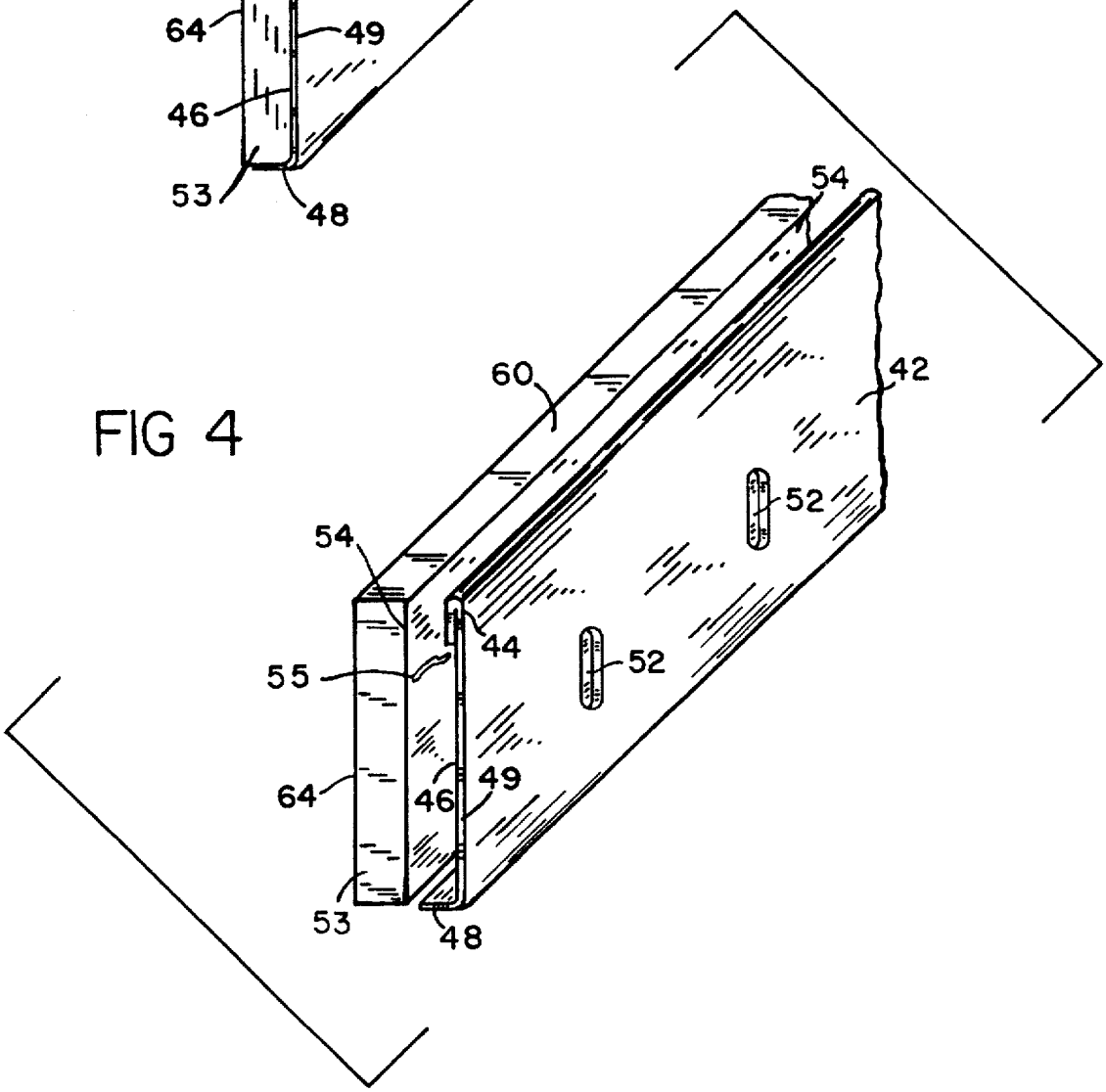
FIG. 4 is substantially a perspective plan view.

The main body screed 42 is affixed to the cabinet structure 34 by a fastener means, such as nails 50, through multiple nailing slots 52 which are more clearly shown in FIGS. 3 & 4, respectively.

Our new invention (herein known as an "P-strip II") further includes a second unit which is substantially an elongated rectangular stress barrier member 53 which, in the preferred embodiment, is formed of a high-density small bead foam with one of its sides 54 conforming in size and shape to mate with hem 44 and the flat surface 46 of the main body screed 42 when installed, and is fixidly attached to the main body screed by caulking 55. A bond coat 68 is now applied and tile 70 and tile trim-cap 72 are set in place and grouted at joint 74.

It is to be noted that the stress barrier 53 may include upon its "tile-side surface 64, and at least one of its longest edges 60 thereof" a sprayed plastic coating (not shown) for reinforcement if so desired.

It will now be seen that we have provided a new, unusual apparatus and method to isolate the aforementioned stresses described in the above prior art and substantially prevent these stresses from reaching the tile trim-cap, thus reducing their chances of cracking.

It will also be seen that we have eliminated the prior art "A-strip" and we have substituted our prior art "P-strip" with the present "P-strip II", and we have eliminated the need to fill the prior art "A-strip" with mortar, thus reducing costs.

We have also provided a resilient support surface for the tile trim-cap which absorbs the impact of a blow and substantially reduces its tendency to crack.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

Having described the invention, what is claimed as new and desired to be secured by Letters Patent is:

1. In a tile covered structure having a horizontal and vertical surface meeting to form a structure corner and having a plurality of tiles covering at least part of said horizontal surface, and a plurality of corner tiles each formed of substantially horizontal and vertical leg sections positioned at said corner, said tiles being secured to said structure by adhesive material between the tiles and said structure, the improvement comprising: a corner tile support strip attached between the vertical surface and the vertical leg sections of said corner tiles, said corner tile support strip comprising: a first elongated strip being a first main body screed which is substantially shaped to form a backward "L" having a short leg which forms a lip and a long leg, said long leg being substantially straight forming an elongated flat surface having an elongated top edge which is folded over upon itself forming an elongated hem, said flat surface, said hem and said lip each facing toward said vertical leg of said corner tile of said structure, and said screed having multiple nailing slots there through for receiving a fastener means therein for fixedly attaching said screed to said structure, and said corner tile support strip further including: an elongated rectangular stress barrier member having a first side and a tile-side surface, said first side conforming in size and shape to mate with both said hem and said elongated flat surface, and said first side being directly fixedly attached to said screed by caulking.

2. The corner tile support strip of claim 1 further includes a sprayed plastic coating on both said tile-side surface and on at least one of its longest edges, thus providing reinforcement.

3. The corner tile support strip of claim 1 is made from metal.

4. The corner tile support strip of claim 1 in which said stress barrier member is made from a rigid high-density small bead foam.

* * * * *